US009281619B2

(12) United States Patent
Morello et al.

(10) Patent No.: US 9,281,619 B2
(45) Date of Patent: Mar. 8, 2016

(54) VIBRATION RESISTANT CONNECTOR SYSTEM WITH CONNECTOR POSITION ASSURANCE DEVICE

(71) Applicant: DELPHI TECHNOLOGIES, INC., Troy, MI (US)

(72) Inventors: John R. Morello, Warren, OH (US); James M. Rainey, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/250,658

(22) Filed: Apr. 11, 2014

(65) Prior Publication Data

US 2015/0295354 A1 Oct. 15, 2015

(51) Int. Cl.
*H01R 13/639* (2006.01)
*H01R 13/627* (2006.01)

(52) U.S. Cl.
CPC ..... *H01R 13/639* (2013.01); *H01R 13/6272* (2013.01)

(58) Field of Classification Search
USPC ..... 439/352, 350, 354, 489, 347
See application file for complete search history.

(56) References Cited

U.S. PATENT DOCUMENTS 5,192,225 A * 3/1993 Suzuki ..... H01R 13/641 439/350
5,257,944 A * 11/1993 Kennedy ..... H01R 13/639 439/347
5,507,666 A * 4/1996 Yamanashi ..... H01R 13/641 439/354
5,711,684 A * 1/1998 Inoue ..... H01R 13/6272 439/354
6,116,939 A * 9/2000 Fukuda ..... H01R 13/6272 439/354
6,126,480 A * 10/2000 Kawase ..... H01R 13/6272 439/352
6,290,539 B1 * 9/2001 Wilber ..... H01R 13/506 436/595
6,435,895 B1 * 8/2002 Fink ..... H01R 13/6272 439/352
6,679,719 B2 * 1/2004 Endo ..... H01R 13/641 439/352
6,824,417 B1 * 11/2004 Nimura ..... H01R 13/641 439/352
6,857,892 B2 2/2005 McLauchlan
6,884,106 B2 * 4/2005 Shuman ..... H01R 13/6456 439/352

(Continued)

FOREIGN PATENT DOCUMENTS

EP 2 637 260 A1 9/2013

OTHER PUBLICATIONS

USCAR Standard Connector Drawing 064-U-012-2-Z02, Rev. E published Oct. 28, 2004 https://secure.uscarteams.org/secure/vroom1//dwg_frameset.php.

*Primary Examiner* — Alexander Gilman
(74) *Attorney, Agent, or Firm* — Robert J. Myers

(57) ABSTRACT

A connector that is configured to be inserted within a cavity of a shroud defined by a mating connector along a longitudinal axis, including a connector body which defines a first resilient member and a first wedge member that is configured to urge the first resilient member into compressive contact with the shroud of the mating connector along a vertical or longitudinal axis. The connector may include a plurality of pairs of resilient members and wedge members to provide compressive contact along more than one axis. The wedge members may be incorporated into a connector position assurance device (CPA).

18 Claims, 5 Drawing Sheets

(56) References Cited

U.S. PATENT DOCUMENTS 7,399,195 B2 * 7/2008 Kim ..... H01R 13/641 439/352
7,544,081 B2 * 6/2009 Lim ..... H01R 13/4361 439/352
7,682,181 B1 * 3/2010 Jones, Jr. ..... H01R 13/6272 439/352
8,092,245 B2 * 1/2012 Morello ..... H01R 13/6272 439/352
8,616,914 B2 * 12/2013 Mumper ..... H01R 13/6272 439/489
8,926,356 B2 * 1/2015 Kon ..... H01R 13/6272 439/352
2003/0171027 A1 * 9/2003 Shuey ..... H01R 13/641 439/489

* cited by examiner

VIBRATION RESISTANT CONNECTOR SYSTEM WITH CONNECTOR POSITION ASSURANCE DEVICE

TECHNICAL FIELD OF THE INVENTION

The invention generally relates to a connector system, and more particularly relates to a connector body of the system having a resilient member that is configured to dampen vibration between mating connector bodies in the connector system.

BACKGROUND OF THE INVENTION

Sealed connector systems include compliant seals between the mating connector bodies to stop the entry of environmental contaminants, such as, dust, dirt, water or other fluids into the connector bodies of the connector system. These compliant seals also serve to reduce the relative motion between the connector bodies, and hence the electrical terminals within the connector bodies caused by vibration within a vehicle. This relative motion between terminals can cause undesirable intermittent connections or fretting corrosion. Unsealed connection systems do not have compliant seals and typically rely on connector fit/clearances to reduce movement between the connector bodies and can typically can only function in lower vibration environments, such as those associated with a vehicle passenger compartment. Sealed connectors may be used in higher vibration environments where their resistance to environmental contaminants is not required; however, sealed connector systems are typically more expensive than equivalent unsealed connector systems. Therefore, it is desirable to have an unsealed connection system that can withstand higher vibration environments.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a connector configured to be inserted within a cavity of a shroud defined by a mating connector along a first axis is provided. The connector includes a connector body defining a first resilient member and a first wedge member configured to urge the first resilient member into compressive contact with the shroud of the mating connector along a second axis that is orthogonal to the first axis.

The connector body may further define second and third resilient members and the connector may further include second and third wedge members that are configured to urge the second and third resilient members into compressive contact with the shroud along a third axis that is orthogonal to both the first axis and the second axis. The first resilient member may be urged into compressive contact with a first inner wall of the shroud, the second resilient member may be urged into compressive contact with a second inner wall of the shroud adjacent the first inner wall, and the third resilient member may be urged into compressive contact with a third inner wall of the shroud opposing the second inner wall. The first, second, and third resilient members may be resilient cantilever beams.

The first resilient member may define a lock notch that is configured to engage a lock nib defined by the mating connector, thereby securing the connector body within the shroud of the mating connector.

The connector may also include a connector position assurance device that defines the first, second, and third wedge members. The first, second, and third wedge members are not in contact with the first, second, and third resilient members when the connector position assurance device is in a disengaged position and the first, second, and third wedge members are in compressive contact with the first, second, and third resilient members when the connector position assurance device is in an engaged position. The lock notch may be disengaged from the lock nib by pressing on a free end of the first resilient member when the connector position assurance device is in the disengaged position and wherein the lock notch is inhibited from disengaging the lock nib when the connector position assurance device is in the engaged position.

In another embodiment of the present invention, a connector system is provided. The connector system includes a first connector body defining a shroud and a second connector body that is configured to be inserted within a cavity defined by the shroud along a first axis. The second connector body includes a first resilient member. The connector system also includes a first wedge member that is configured to urge the first resilient member into compressive contact with the first connector body along a second axis that is orthogonal to the first axis, thereby inhibiting relative motion between the first connector body and the second connector body.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

An unsealed connector system having features to reduce or inhibit relative motion between the connector bodies of the connection system is presented herein. One of the connector bodies has at least one resilient member that is wedged against a shroud of the mating connector body, thus limiting the relative motion between the connector bodies along at least one axis. One embodiment described here includes three resilient members and a connector position assurance device that has three wedge members which force the resilient members against the interior walls of the shroud, thus limiting the relative motion between the connector bodies along at least two orthogonal axes.

Figure 1:
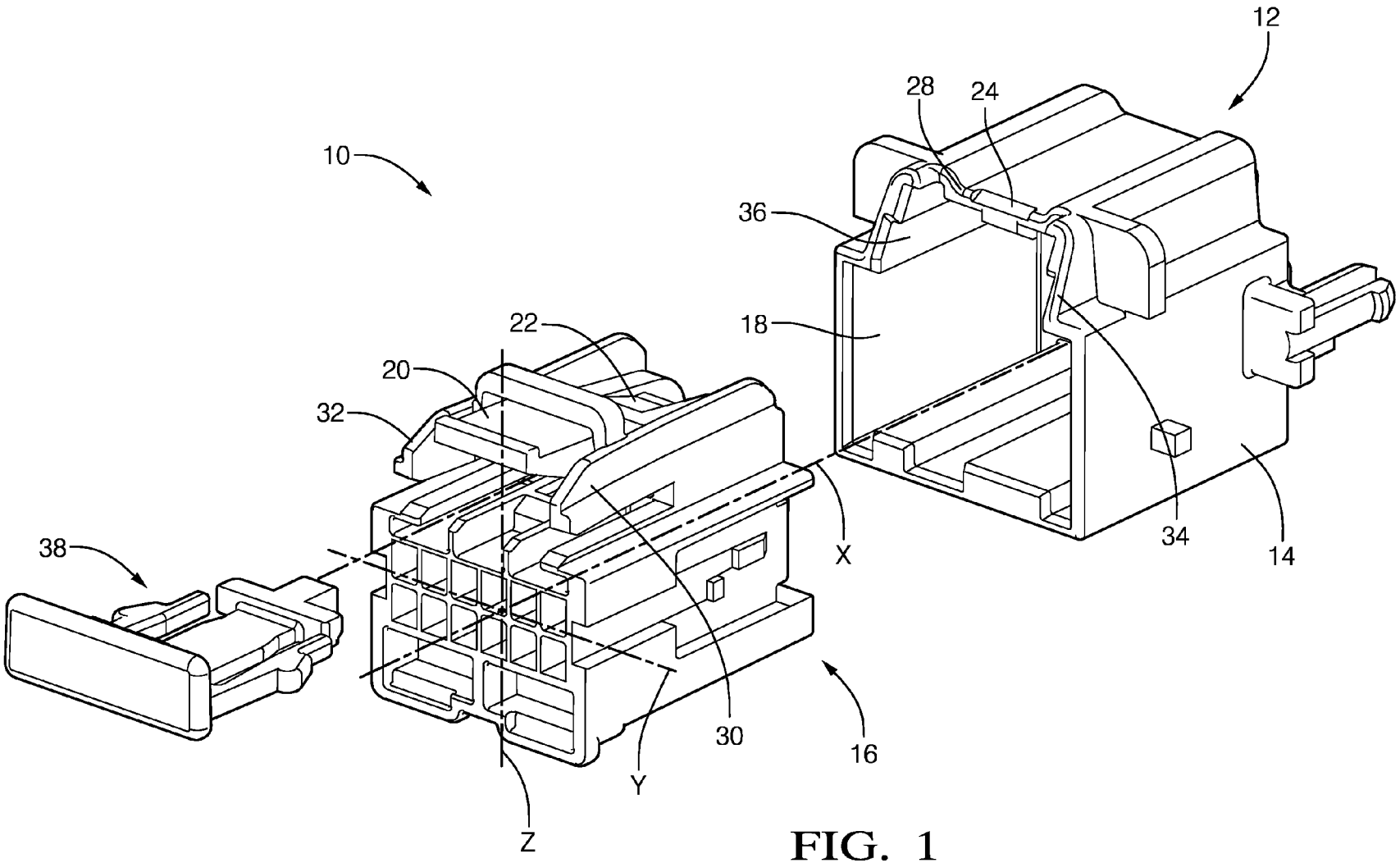
FIG. 1 is an exploded perspective view of a connector system including a connector position assurance device (CPA) having several resilient members and wedge members in accordance with one embodiment.

FIG. 1 illustrates a non-limiting example of a connector system 10 that includes a first connector body 12, hereinafter referred to as the female connector body 12, which defines a shroud 14. The female connector body 12 is designed to accommodate a number of male or plug electrical terminals (not shown) that are attached to wire cables (not shown), such as those of a wire harness assembly (not shown). The female connector body 12 is formed of a dielectric material, such as such as polyamide (PA), polypropylene (PP), or polybutylene terephthalate (PBT).

The connector system 10 also includes a second connector body 16, hereinafter referred to as the male connector body 16, which is configured to be inserted within a cavity 18 defined by the shroud 14 of the female connector body 12 along a first axis, hereinafter referred to as the longitudinal or X axis. The male connector body 16 is designed to accommodate a number of female or socket electrical terminals (not shown) that are attached to wire cables (not shown), such as those of another wire harness assembly (not shown). The male connector body 16 is also formed of a dielectric material, such as such as PA, PP, or PBT.

The male connector body 16 defines a first resilient member 20 which is a resilient cantilever beam that is longitudinally oriented. The first resilient member 20 is configured to flex along a second axis which is orthogonal to the longitudinal axis, hereinafter referred to as the vertical or Z axis. The first resilient member 20, hereafter referred to as the lock arm 20, defines a lock notch 22 that is designed to engage a lock nib 24 that protrudes from the interior of the shroud 14 of the female connector body 12. When the lock nib 24 is engaged with the lock notch 22, the male connector body 16 is secured within the shroud 14 of the female connector body 12, thereby limiting relative movement of the male and female connector bodies 12, 16 along the longitudinal axis X. A free end 26 of the lock arm 20 may be pressed to disengage the lock nib 24 from the lock notch 22 in order to permit the male connector body 16 to be removed from the shroud 14. A portion of the lock arm 20 is proximate a top inner wall 28 of the shroud 14 when the male connector body 16 is fully inserted within the shroud 14 of the female connector body 12.

The male connector body 16 further includes a second resilient member 30 and a third resilient member 32 which are both resilient cantilever beams. The second and third resilient members 30, 32 are also longitudinally oriented. The second and third resilient members 30, 32 are configured to flex along a third axis which is orthogonal to the longitudinal X and vertical Z axes, hereinafter referred to as the lateral or Y axis. According to the illustrated embodiment, the second and third resilient members 30, 32 flank the lock arm 20 and may be referred to as lock arm protection rails 30, 32. The second compliant member 30 is proximate a first inner side wall 34 of the shroud 14 and the third complaint member 32 is proximate a second inner side wall 36 opposite the first inner side wall 34.

The male connector body 16 further includes a connector position assurance device 38 (CPA) which is slideably retained on the male connector body 16. The CPA 38 is also formed of a dielectric material, such as such as PA, PP, or PBT. The CPA 38 is slideably moveable between a rearward disengaged position 40 shown in FIGS. 2, 3, and 4 where the lock arm 20 is free to flex bringing the lock notch 22 in and out of engagement with the lock nib 24 and a forward engaged position 42 shown in FIGS. 5, 6 and 7 where the CPA 38 prevents the lock arm 20 from flexing and disengaging the lock notch 22 from the lock nib 24.

The CPA 38 also defines a plurality of wedge members 44, 46, 48. The wedge members 44, 46, 48 are located on the rearward portion of the CPA 38 and are configured to contact the resilient members 20, 30, 32 when the CPA 38 is in the engaged position 42 and not contact the resilient members 20, 30, 32 when the CPA 38 is in the disengaged position 40. A first wedge member 44 located on a top surface of the CPA 38 is configured contact the free end 26 of the lock arm 20 when the CPA 38 is in the engaged position 42 to urge the lock arm 20 into compressive contact with the top inner wall 28 of the shroud 14 along the vertical axis Z, thereby inhibiting relative motion between the male and female connector bodies 12, 16 along the vertical axis Z. A second wedge member 46 located on a side surface of the CPA 38 is configured to urge the second resilient member 30 into compressive contact with the first inner side wall 34 of the shroud 14 along the lateral axis Y and a third wedge member 48 located on an opposite side surface of the CPA 38 is configured to urge the third resilient member 32 into compressive contact with the second inner side wall 36 of the shroud 14 along the lateral axis Y, thereby inhibiting relative motion between the male and female connector bodies 12, 16 along the lateral axis Y. As used herein, compressive contact produces a reaction force between the resilient members 20, 30, 32 and the inner walls 28, 34, 36 of the shroud 14.

Figure 2:
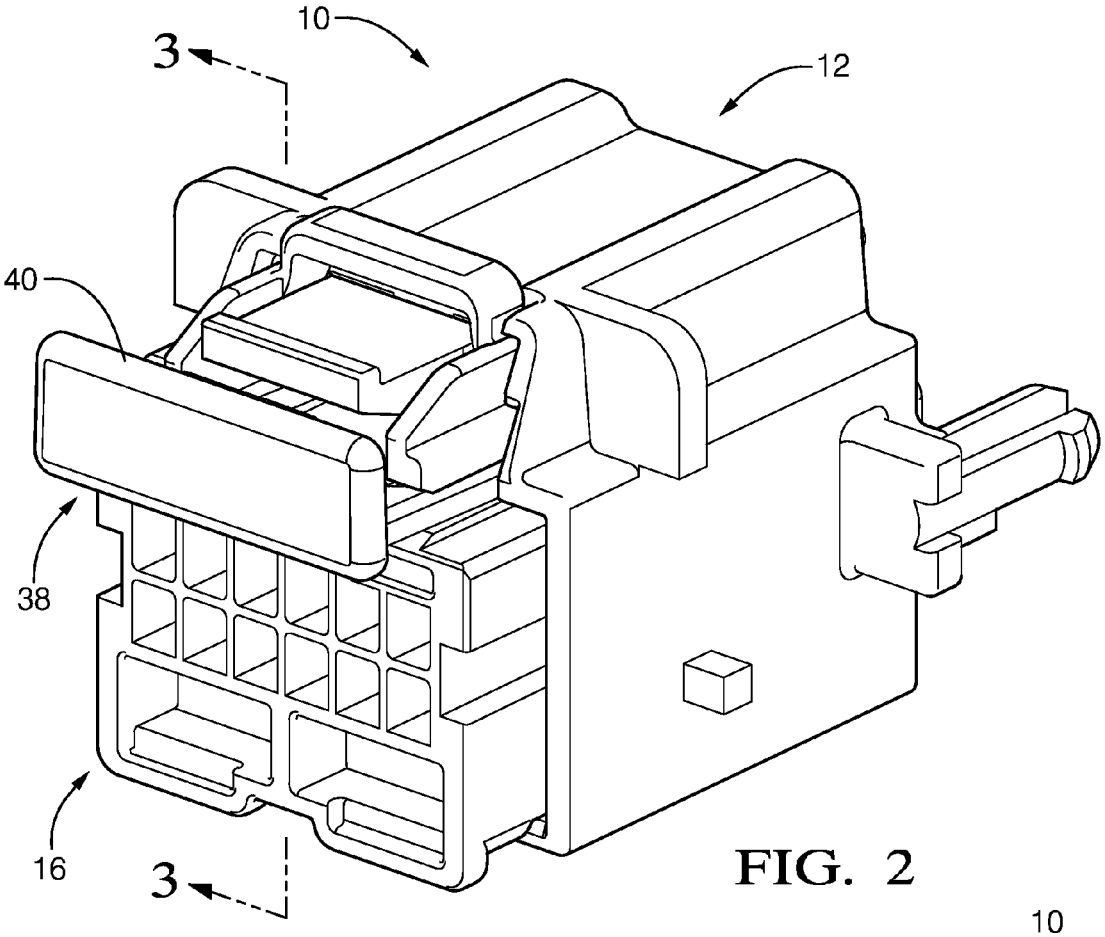
FIG. 2 is a perspective view of the connector system of FIG. 1 in an assembled condition with the CPA is a disengaged position in accordance with one embodiment.
Figure 3:
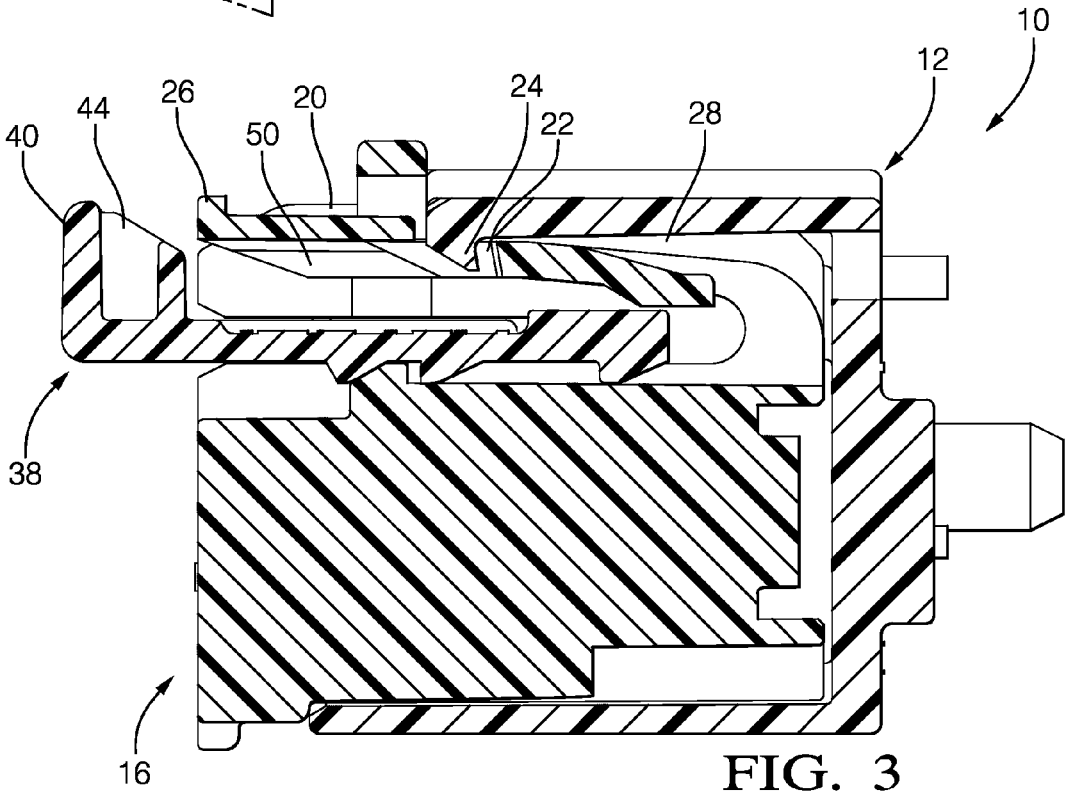
FIG. 3 is a cross sectional side view of the connector system of FIG. 2 in accordance with one embodiment.
Figure 4:
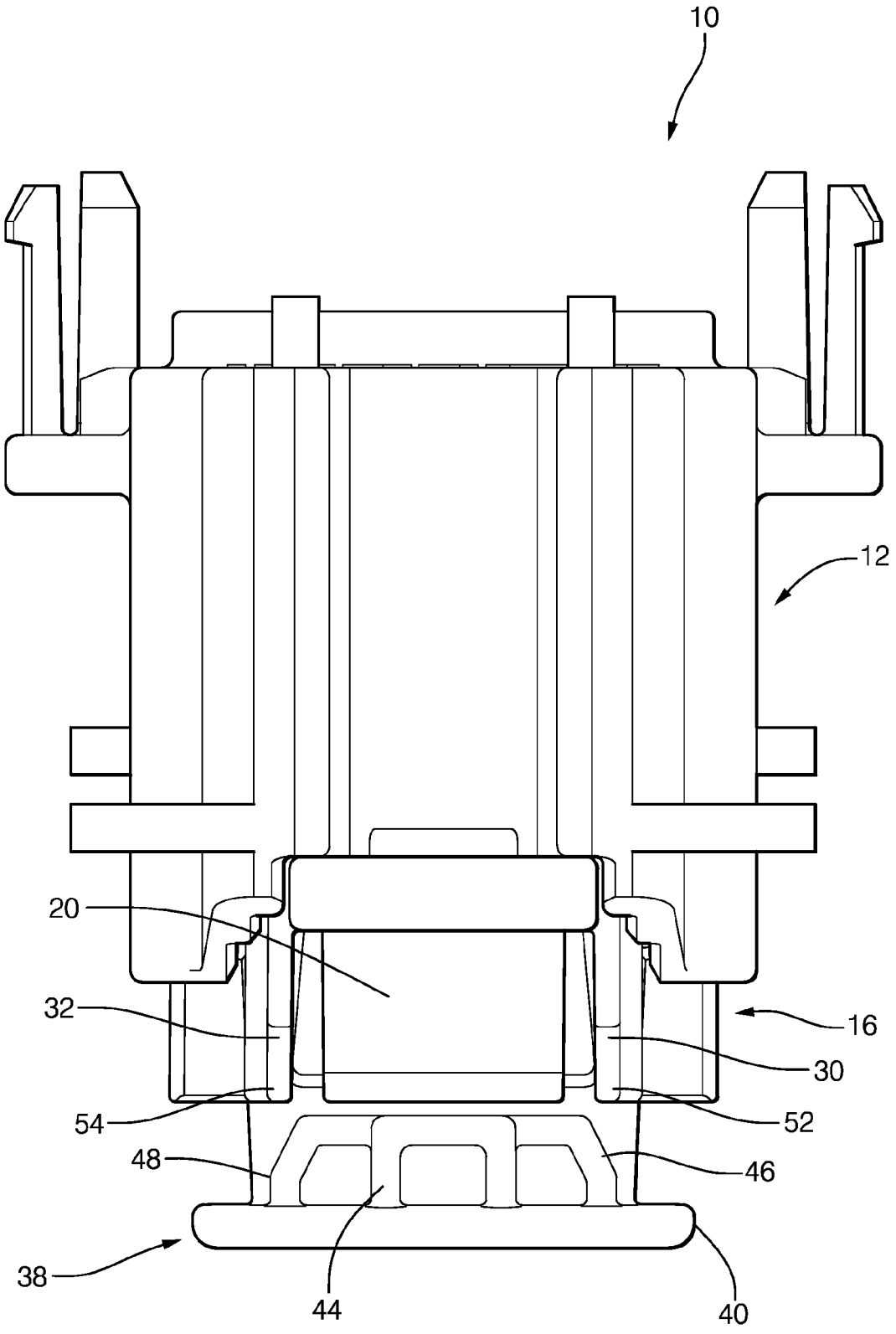
FIG. 4 is a top view of the connector system of FIG. 2 in accordance with one embodiment.

FIGS. 2-4 illustrate the connector system 10 with the male connector body 16 fully inserted within the female connector body 12 and the CPA 38 in the rearward disengaged position 40. In this disengaged position 40, the first wedge member 44 is not in contact with the lock arm 20 nor is the second and third wedge members 46, 48 in contact with the lock arm protection rails 30, 32. As shown in FIG. 3, the lock notch 22 of the lock arm 20 is engaged with the lock nib 24 of the female connector body 12. However, the lock arm 20 is not in contact with the upper inner side wall 28 of the shroud 14. As shown in FIG. 4, the lock protection rails are substantially parallel to each other and are not contacting the first or second inner side walls 34, 36 of the shroud 14. As used herein, substantially parallel means±2° of absolutely parallel.

Figure 5:
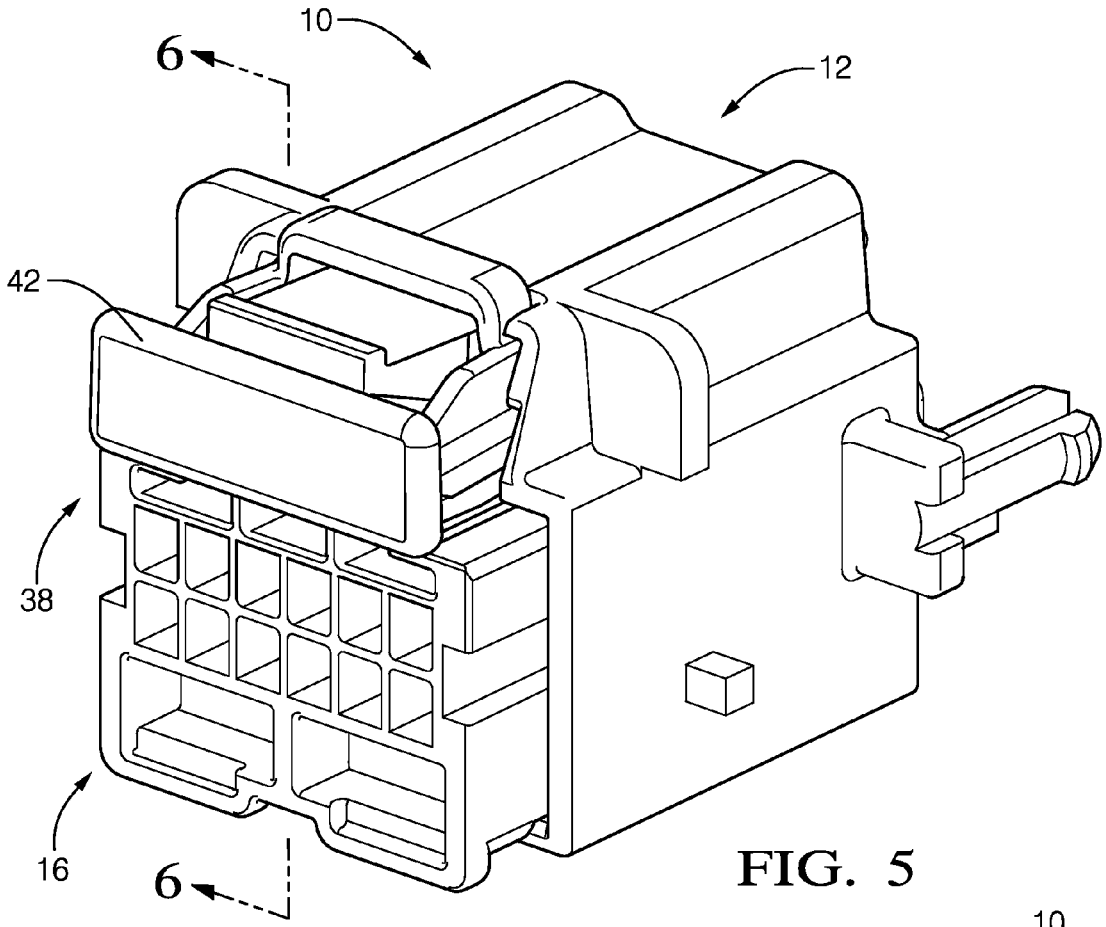
FIG. 5 is a perspective view of the connector system of FIG. 1 in an assembled condition with the CPA in a engaged position in accordance with one embodiment.
Figure 6:
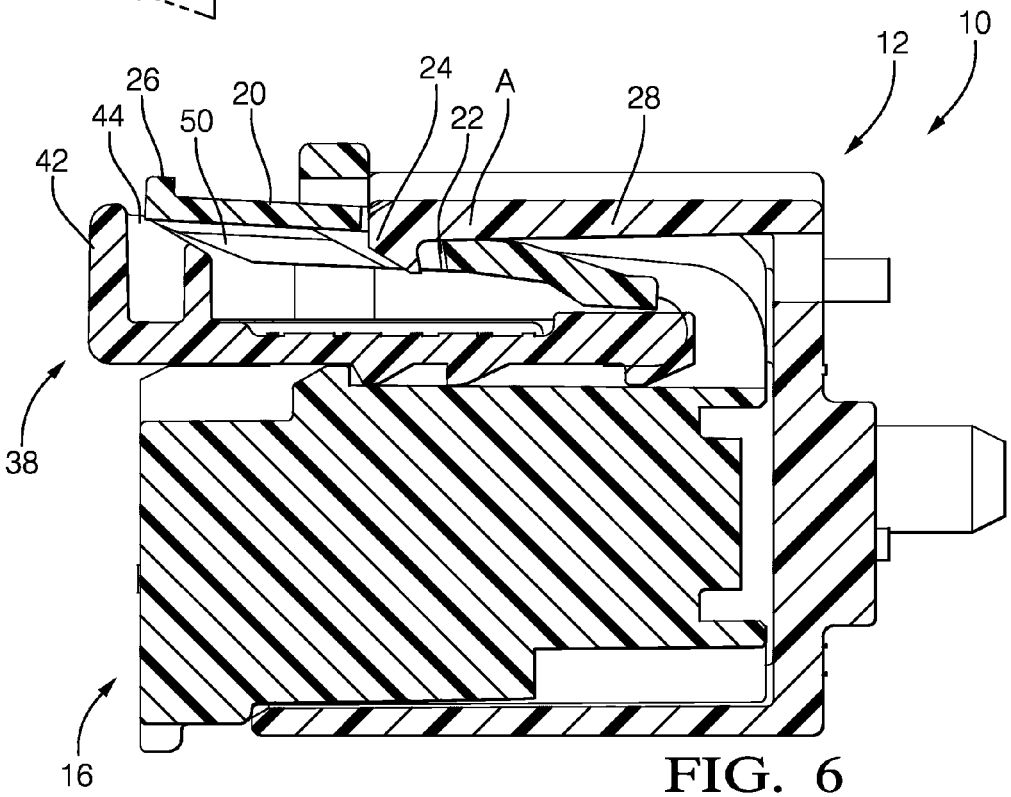
FIG. 6 is a cross sectional side view of the connector system of FIG. 5 in accordance with one embodiment.
Figure 7:
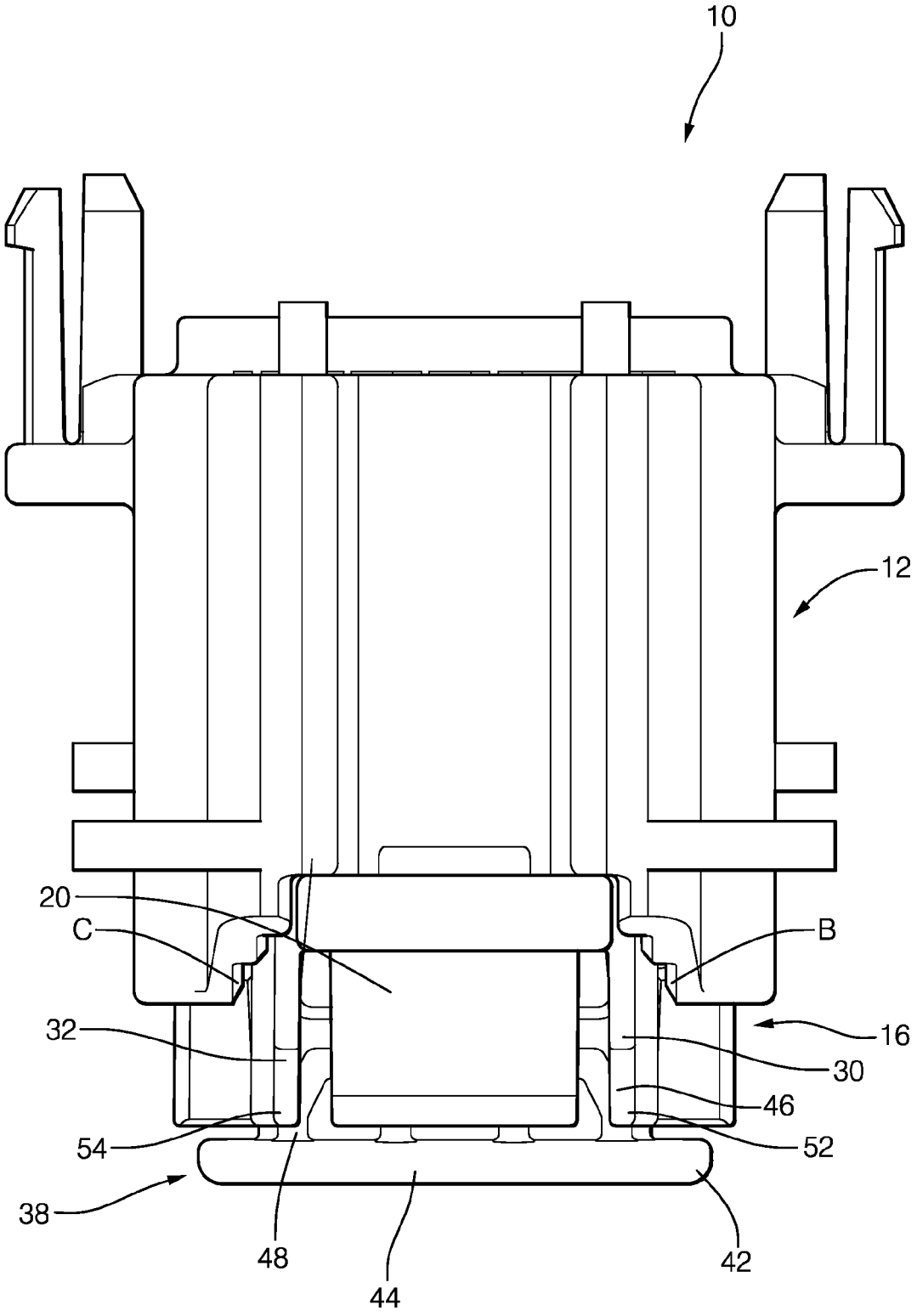
FIG. 7 is top view of the connector system of FIG. 5 in accordance with one embodiment.

FIGS. 5-7 illustrate the connector system 10 with the male connector body 16 fully inserted within the female connector body 12 and the CPA 38 in the forward engaged position 42. In this engaged position 42, the first wedge member 44 is in compressive contact with the lock arm 20 and the second and third wedge members 46, 48 are in compressive contact with the lock arm protection rails 30, 32. As shown in FIG. 6, the free end 26 of the lock arm 20 is forced up by the first wedge member 44 contacting the ramp 50 on the bottom side of the lock arm 20. The lock arm 20 flexes upward pushing the lock arm 20 into compressive contact with the upper side wall 28 at point A. As shown in FIG. 7, the free ends 52, 54 of the lock arm protection rails 30, 32 are forced apart by the second and third wedge members 46, 48 flexing the lock arm protection rails 30, 32 outwardly so they are no longer parallel with each other and pushing the lock protection rails into compressive contact with the side walls 34, 36 of the shroud 14 at points B and C.

The examples presented herein are directed to electrical connectors, however other embodiments of the connector system 10 may be envisioned that are adapted for use with hydraulic, pneumatic, optical, or hybrid connectors including connections of various types. Although the embodiment presented here is an unsealed connector system, other embodiments of the connector system may be envisioned that also include environmental seals.

Accordingly, a connector system 10 having a connector position assurance device 38 that in addition to preventing inadvertent release of the lock arm 20 includes wedge members 44, 46, 48 that force resilient members 20, 30, 32 of the male connector body 16 into compressive contact with the female connector body 12. This provides the benefit of inhibiting relative vertical and/or lateral motion between the connector bodies 12, 16 without the inclusion of sealing elements.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector configured to be inserted within a cavity of a shroud defined by a mating connector along a first axis, comprising:

a connector body defining a first resilient member; and a connector position assurance device defining a first wedge member configured to urge the first resilient member into compressive contact with the shroud of the mating connector along a second axis orthogonal to the first axis, wherein the connector body further defines a second resilient member and wherein said connector position assurance device further includes a second wedge member configured to urge the second resilient member into compressive contact with the shroud along a third axis orthogonal to the first axis and the second axis.

2. The connector in accordance with claim 1, wherein the connector body further defines a third resilient member and wherein said connector position assurance device further includes a third wedge member configured to urge the third resilient member into compressive contact with the shroud along the third axis.

3. The connector in accordance with claim 2, wherein the first resilient member is urged into compressive contact with a first inner wall of the shroud, the second resilient member is urged into compressive contact with a second inner wall of the shroud adjacent the first inner wall, and the third resilient member is urged into compressive contact with a third inner wall of the shroud opposing the second inner wall.

4. The connector in accordance with claim 3, wherein the first resilient member is a resilient cantilever beam.

5. The connector in accordance with claim 4, wherein the second resilient member and the third resilient member are resilient cantilever beams.

6. The connector in accordance with claim 5, wherein the first, second, and third wedge members are not in contact with the first, second, and third resilient members when the connector position assurance device is in a disengaged position and the first, second, and third wedge members are in compressive contact with the first, second, and third resilient members when the connector position assurance device is in an engaged position.

7. A connector configured to be inserted within a cavity of a shroud defined by a mating connector along a first axis, comprising;

a connector body defining a first resilient cantilever beam urged into compressive contact with a first inner wall of the shroud, a second resilient cantilever beam urged into compressive contact with a second inner wall of the shroud adjacent the first inner wall, and a third resilient cantilever beam urged into compressive contact with a third inner wall of the shroud opposing the second inner wall, wherein the first cantilever beam defines a lock notch configured to engage a lock nib defined by the mating connector, thereby securing the connector body within the shroud of the mating connector; and a connector position assurance device defining a first wedge member configured to urge the first cantilever beam into compressive contact with the shroud of the mating connector along a second axis orthogonal to the first axis, a second wedge member configured to urge the second cantilever beam into compressive contact with the shroud along a third axis orthogonal to the first axis and the second axis, and a third wedge member configured to urge the third cantilever beam into compressive contact with the shroud along the third axis.

8. The connector in accordance with claim 7, wherein the first, second, and third wedge members are not in contact with the first, second, and third cantilever beams when the connector position assurance device is in a disengaged position and the first, second, and third wedge members are in compressive contact with the first, second, and third cantilever beams when the connector position assurance device is in an engaged position.

9. The connector in accordance with claim 8, wherein the lock notch may be disengaged from the lock nib by pressing on a free end of the first cantilever beam when the connector position assurance device is in the disengaged position and wherein the lock notch is inhibited from disengaging the lock nib when the connector position assurance device is in the engaged position.

10. The connector system, comprising:

a first connector body defining a shroud;

a second connector body configured to be inserted within a cavity defined by said shroud along a first axis and defining a first resilient member; and a connector position assurance device that defines a first wedge member configured to urge the first resilient member into compressive contact with the first connector body along a second axis orthogonal to the first axis, thereby inhibiting a relative motion between the first connector body and the second connector body, wherein the second connector body further defines a second resilient member and wherein said connector position assurance device further includes a second wedge member configured to urge the second resilient member into compressive contact with the first connector body along a third axis orthogonal to the first axis and the second axis.

11. The connector system in accordance with claim 10, wherein the second connector body further defines a third resilient member and wherein said connector position assurance device further includes a third wedge member configured to urge the third resilient member into compressive contact with the first connector body along the third axis.

12. The connector system in accordance with claim 11, wherein the first resilient member is urged into compressive contact with a first inner wall of the shroud, the second resilient member is urged into compressive contact with a second inner wall of the shroud adjacent the first inner wall, and the third resilient member is urged into compressive contact with a third inner wall of the shroud opposing the second inner wall.

13. The connector system in accordance with claim 12, wherein the first resilient member is a resilient cantilever beam.

14. The connector system in accordance with claim 13, wherein the second resilient member and the third resilient member are resilient cantilever beams.

15. The connector system in accordance with claim 14, wherein the first, second, and third wedge members are not in contact with the first, second, and third resilient members when the connector position assurance device is in a disengaged position and the first, second, and third wedge members are in compressive contact with the first, second, and third resilient members when the connector position assurance device is in an engaged position.

16. A connector system, comprising;

a first connector body defining a shroud and an inwardly extending lock nib;

a second connector body configured to be inserted within a cavity defined by said shroud along a first axis and defining a first resilient cantilever beam urged into compressive contact with a first inner wall of the shroud, a second resilient cantilever beam urged into compressive contact with a second inner wall of the shroud adjacent the first inner wall, and a third resilient cantilever beam urged into compressive contact with a third inner wall of the shroud opposing the second inner wall, wherein the first cantilever beam defines a lock notch configured to engage said lock nib, thereby securing the second connector body within the shroud of the first connector body; and a connector position assurance device that defines a first, wedge member configured to urge the first resilient member into compressive contact with the first connector body along a second axis orthogonal to the first axis, thereby inhibiting relative motion between the first connector body and the second connector body, a second wedge member configured to urge the second resilient member into compressive contact with the first connector body along a third axis orthogonal to the first axis and the second axis, and a third wedge member configured to urge the third resilient member into compressive contact with the first connector body along the third axis.

17. The connector system in accordance with claim 16, wherein the first, second, and third wedge members are not in contact with the first, second, and third cantilever beams when the connector position assurance device is in a disengaged position and the first, second, and third wedge members are in compressive contact with the first, second, and third cantilever beams when the connector position assurance device is in an engaged position.

18. The connector system in accordance with claim 17, wherein the lock notch may be disengaged from the lock nib by pressing on a free end of the first cantilever beam when the connector position assurance device is in the disengaged position and wherein the lock notch is inhibited from disengaging the lock nib when the connector position assurance device is in the engaged position.

* * * * *